US011013391B2

(12) United States Patent
Smith et al.

(10) Patent No.: US 11,013,391 B2
(45) Date of Patent: May 25, 2021

(54) SCRAPER APPARATUS AND METHOD

(71) Applicants: David G. Smith, Lehi, UT (US); Fred P. Smith, Alpine, UT (US)

(72) Inventors: David G. Smith, Lehi, UT (US); Fred P. Smith, Alpine, UT (US)

( * ) Notice: Subject to any disclaimer, the term of this patent is extended or adjusted under 35 U.S.C. 154(b) by 7 days.

(21) Appl. No.: 16/198,753

(22) Filed: Nov. 21, 2018

(65) Prior Publication Data

US 2019/0159647 A1 May 30, 2019

Related U.S. Application Data

(60) Provisional application No. 62/591,268, filed on Nov. 28, 2017.

(51) Int. Cl.

| | |
|---|---|
| ***A47L 13/08*** | (2006.01) |
| ***B08B 1/00*** | (2006.01) |
| ***A47L 13/12*** | (2006.01) |
| ***A46B 17/08*** | (2006.01) |
| ***A43B 15/00*** | (2006.01) |
| ***A47L 13/022*** | (2006.01) |
| ***B25G 3/12*** | (2006.01) |
| ***A46B 15/00*** | (2006.01) |

(52) U.S. Cl.

CPC ..... *A47L 13/08* (2013.01); *A46B 15/0081* (2013.01); *A46B 17/08* (2013.01); *A47L 13/022* (2013.01); *A47L 13/12* (2013.01); *B08B 1/005* (2013.01); *B25G 3/12* (2013.01)

(58) Field of Classification Search

CPC ..... A46B 15/0081; A46B 17/00; A46B 17/08; A47L 13/12; A47L 13/02; A47L 13/08; B08B 1/005; B44D 3/162; B44D 3/164

USPC ..... 15/111, 236.01, 236.02, 246; 30/169; D4/118; D32/42, 46, 48, 49

See application file for complete search history.

(56) References Cited

U.S. PATENT DOCUMENTS

| | | | | | |
|---|---|---|---|---|---|
| 412,002 | A | * | 10/1889 | Schroen | 15/246 |
| 619,975 | A | * | 2/1899 | Martin | |
| 688,160 | A | * | 12/1901 | Clarke | 15/246 |
| 972,225 | A | * | 10/1910 | Pennell | 30/169 |
| 1,018,518 | A | * | 2/1912 | Pettit | A47L 11/4038 15/246 |
| 1,442,559 | A | * | 1/1923 | Doty | B44D 3/162 30/335 |
| 1,927,202 | A | * | 9/1933 | Burdick | B44D 3/162 30/169 |
| 2,212,197 | A | * | 8/1940 | Roesch | B44D 3/162 30/169 |

(Continued)

FOREIGN PATENT DOCUMENTS

| | | | |
|---|---|---|---|
| GB | 362 | * | 10/1910 |
| GB | 2085789 | * | 5/1982 |

*Primary Examiner* — Mark Spisich

(74) *Attorney, Agent, or Firm* — Kirton McConkie; Alexis Nelson

(57) ABSTRACT

An apparatus for scraping a surface. The apparatus includes an attachment element to attach to a cleaning tool, and a scraper element. The scraper element is coupled to the attachment element and includes a blade member and a guard member. The leading edge of the blade member is used to scrape the surface, while the guard member is disposed along one or more lateral edges of the blade member. A corresponding system and method are also disclosed and claimed herein.

18 Claims, 12 Drawing Sheets

(56) References Cited

U.S. PATENT DOCUMENTS

| | | | | | |
|---|---|---|---|---|---|
| 2,856,621 | A | * | 10/1958 | Racicot | A46B 17/08 15/105 |
| 2,981,964 | A | * | 5/1961 | Downing | A63B 57/60 15/105 |
| D193,887 | S | * | 10/1962 | Hauser | D4/118 |
| 5,095,573 | A | * | 3/1992 | Henke | E04F 21/00 15/105 |
| 9,770,094 | B1 | * | 9/2017 | Gresham | A47L 13/022 |

* cited by examiner

SCRAPER APPARATUS AND METHOD

PRIORITY INFORMATION

This application claims priority to U.S. Provisional App. No. 62/591,268 filed on Nov. 28, 2017, entitled, "A Floor Scraper for Use with Brooms, Mops, and the Like."

BACKGROUND

Field of the Invention

This invention relates to the field of cleaning tools. More particularly this invention relates to apparatuses and methods for scraping a surface.

Background of the Invention

Objects often get stuck to floors and other surfaces with such force that they are difficult or impossible to remove with a typical cleaning tool, such as a broom or mop. For this reason, scraper devices have been used to aid in the cleaning of floors and other surfaces, and particularly to remove stuck objects. Most often, scrapers have been integrated in connection with push brooms or warehouse brooms near the cleaning head. Although scrapers have also been integrated into mid-sized brooms of the type typically found in homes and kitchens, these scrapers typically need to be extended or completely detached to be used.

Scrapers attached near the cleaning head can lead to poor performance of the cleaning tool due to added weight, undesirable interference of the scraper, and/or a complicated mechanism required to move the scraper or brush for use. Since scrapers are typically formed from metal or hard plastic with sharp corners, scrapers provided on the other end of the handle may pose a danger to people, cabinets, walls, appliances, pets, and the like. Indeed, the handle of long-handled cleaning tools such as brooms and mops are often leaned against walls, counters, and chairs. Falling from such a propped position may result in an attached scraper causing serious damage to anything in its way.

What are needed are apparatuses and methods for scraping a surface that are simple, effective, inexpensive, and safe. Also what are needed are apparatuses and methods that can be easily implemented in connection with domestic cleaning tools, and that do not interfere with the primary purpose of the associated cleaning tool. Ideally, such apparatuses and methods would be easily adapted to cleaning tools having various dimensions. Such apparatuses and methods are disclosed and claimed herein.

BRIEF DESCRIPTION OF DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

Figure 1:
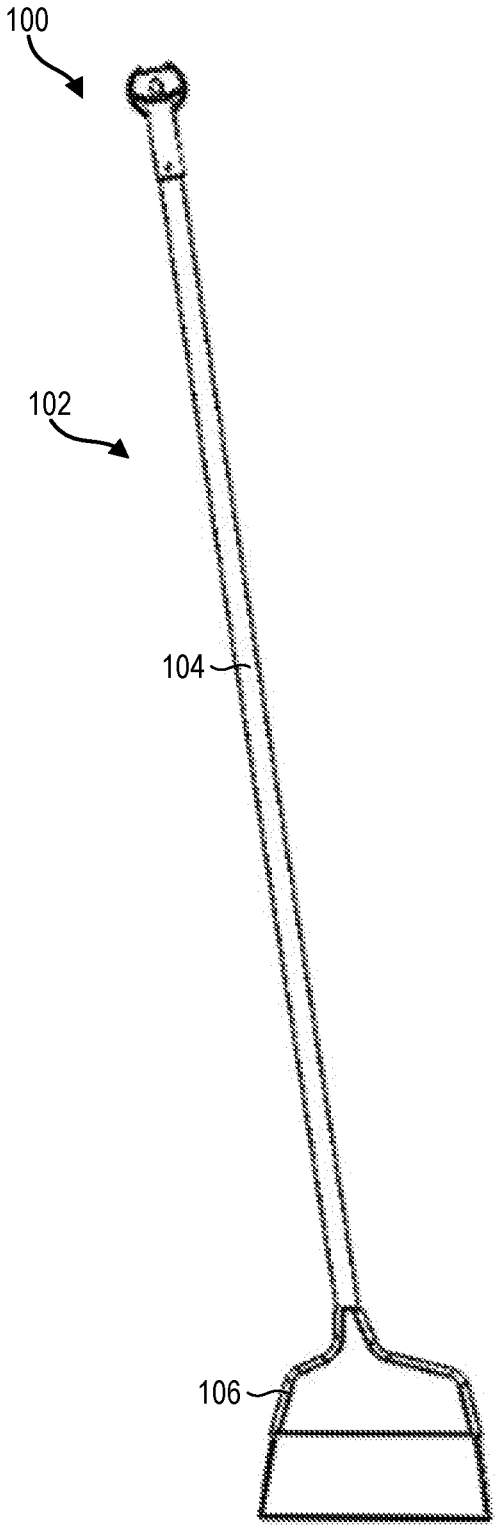
FIG. 1 is a perspective view of a long-handled cleaning tool having an attached scraper apparatus in accordance with certain embodiments of the invention.

Referring now to FIG. 1, embodiments of the present invention may provide a novel scraper apparatus 100 to be integrated on the upper portion of a handle 104 of a cleaning tool 102, the apparatus 100 being attached at the opposite end of the cleaning head 106. The scraper apparatus 100 may be designed and shaped such that it can scrape stuck objects off of a floor or other surface, without posing a risk or hazard should the cleaning tool 102 fall to the ground. Indeed, a scraper apparatus 100 in accordance with embodiments of the invention may have rounded corners and may further include a protector such that the scraping edge will not damage cabinets, doors, or floors, and is safe to use around children and pets. This protector or guard may also protect distal ends of the scraping edge from digging into the flooring. In some embodiments, the scraper apparatus 100 may also be accompanied by a scrubber or other cleaning device or accessory.

As shown in FIG. 1, in some embodiments, a scraper apparatus 100 in accordance with the invention may attach to the handle 104 of a cleaning tool 102, such as mop, broom, or any other such cleaning tool 102 known to those in the art. The scraper apparatus 100 may be attached at or near an end of the handle 104 opposite the cleaning head 106.

Figure 2A:
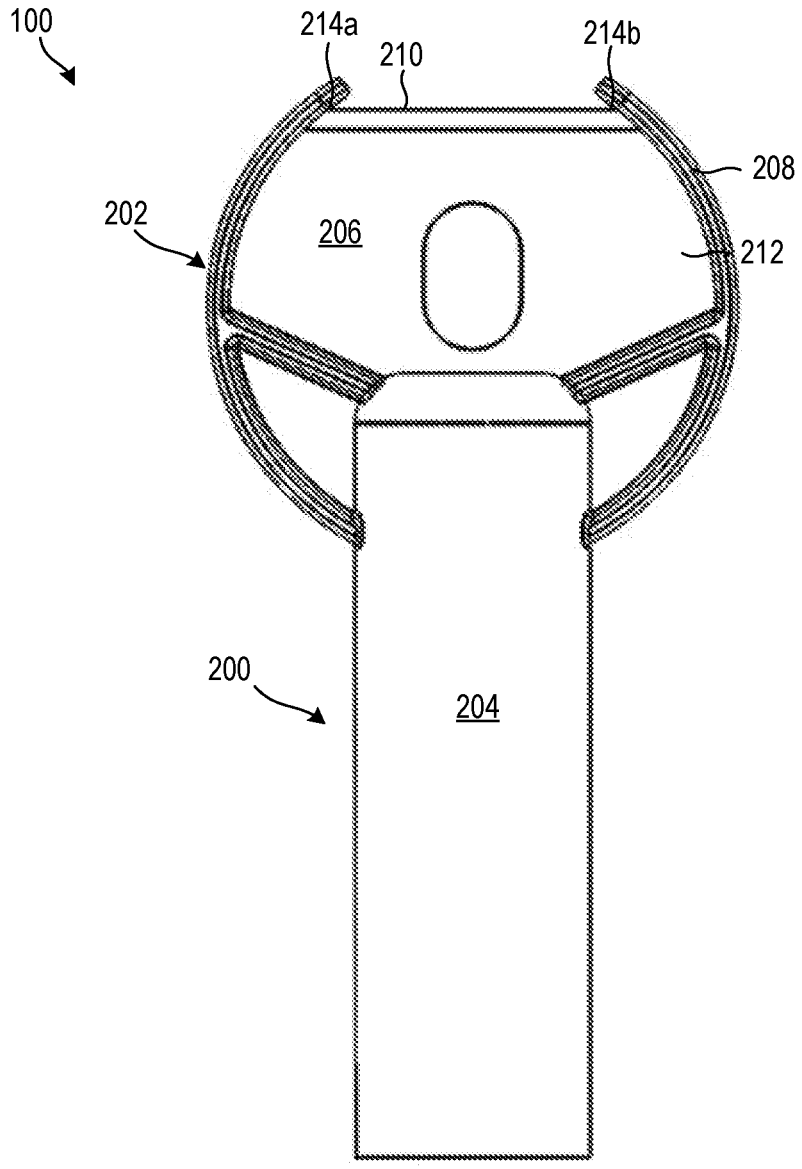
FIG. 2*a* is a front view of a scraper apparatus in accordance with embodiments of the present invention.
Figure 2B:
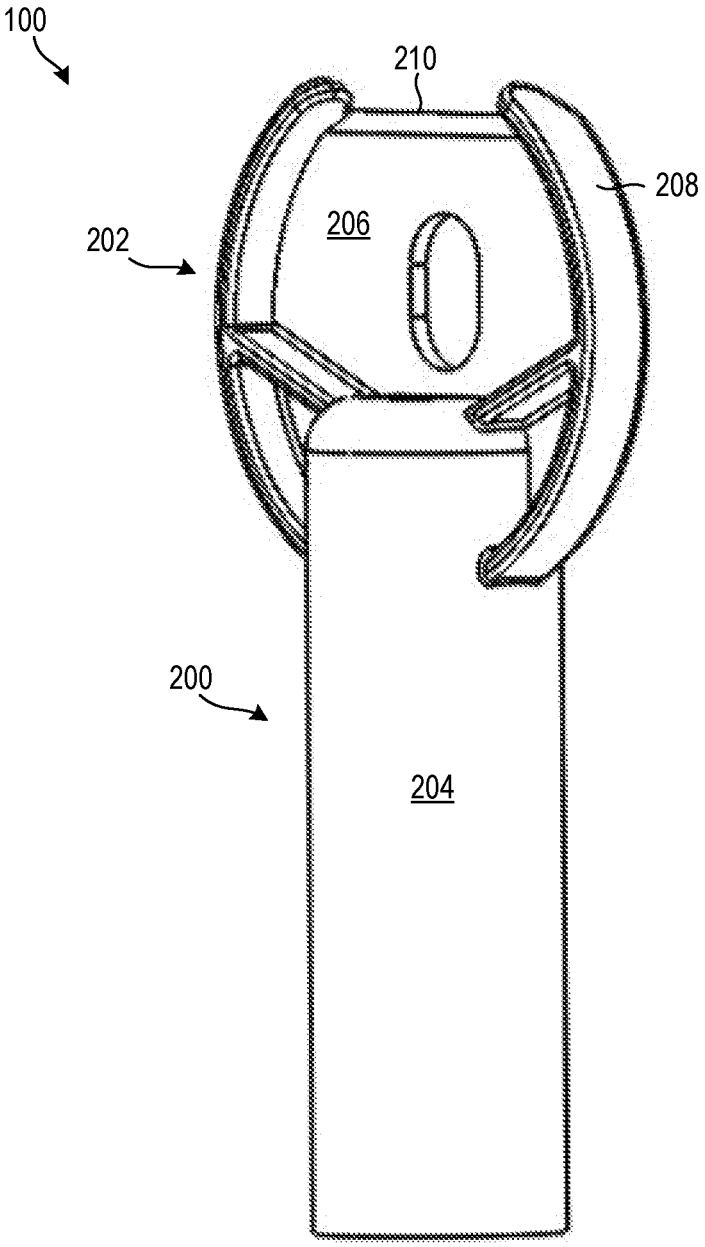
FIG. 2*b* is a perspective view of the scraper apparatus of FIG. 2*a;*

Referring now to FIGS. 2*a* and 2*b*, in certain embodiments, the scraper apparatus 100 may include an attachment element 200 and a scraper element 202. In one embodiment, as discussed in more detail below with reference to FIG. 3, the attachment element 200 may include a tubular member 204 or sleeve that may fit over or into the end of the handle 104.

In some embodiments, the scraper element 202 may include a blade member 206 and one or more guard members 208. The blade member 206 may include a leading edge 210 and opposing sides or lateral edges 212. In one embodiment, the guard member 208 substantially covers the lateral edges 212 of the blade, leaving the leading edge 210 of the blade member 206 exposed. In some embodiments, the guard members 208 may also protect the distal ends 214*a*, 214*b* of the leading edge 210 from gouging into the floor or surface being scraped.

In some embodiments, the guard members 208 may be injection-molded plastic. The blade member 206 may be integrally molded with the guard member 208, or the guard member 208 may be overmolded onto a metal blade member 206 or other type of blade member 206 known to those in the art. In other embodiments, the blade member 206 may be formed separately from the guard member 208. In one embodiment, the guard member 208 may be fitted with a soft outer lining such as rubber, foam, thermoplastic elastomers ("TPE") or the like, which may be overmolded onto the blade member 206.

As best seen in FIG. 2*b*, in certain embodiments, at least a portion of one or more guard members 208 may extend past the leading edge 210 of the blade member 206 to provide further protection. The portion of the guard member 208 that extends past the leading edge 210 of the blade member 206 may be angled away from the blade member 206 or otherwise shaped such that the guard member 208 does not inhibit use of the blade member 206, but still guards the leading edge 210 of the blade member 206 should the cleaning tool 102 tip or fall over.

Figure 3:
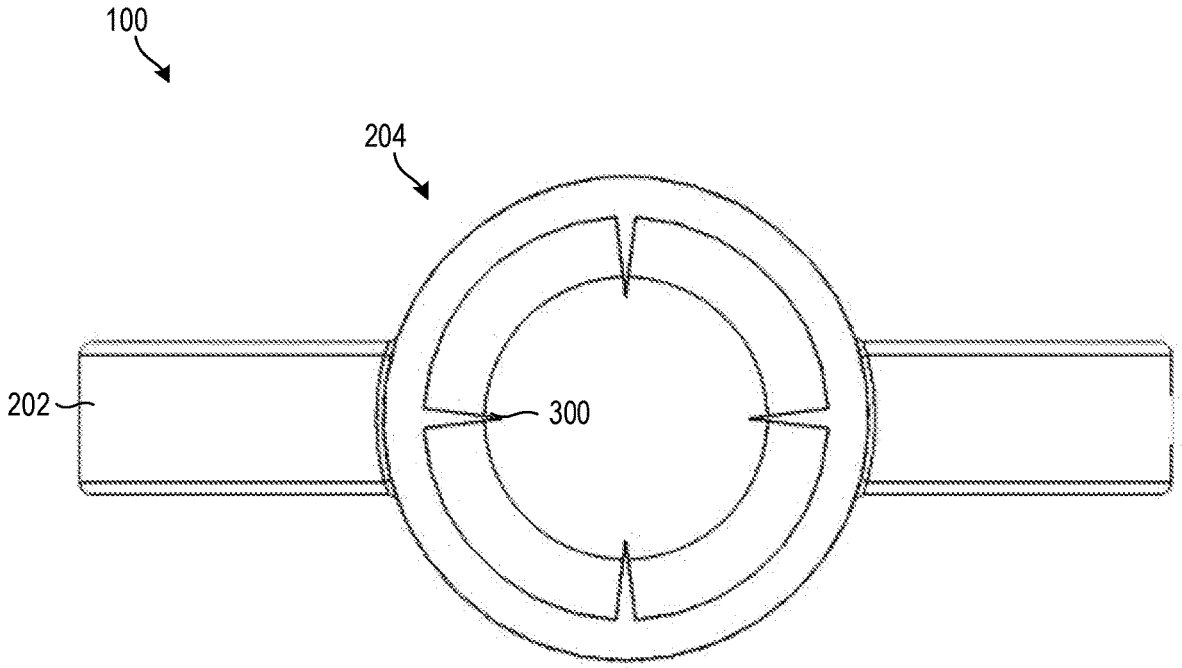
FIG. 3 is a bottom view of one embodiment of a scraper apparatus in accordance with the invention.

As shown in FIG. 3, the tubular member 204 may have internal ribs 300 that deform when the scraper apparatus 100 is attached to the handle 104. This feature may allow the scraper apparatus 100 to be attached to handles 104 of varying sizes. In some embodiments, the tubular member 204 may also be tapered, as shown in FIG. 4, such that a handle 104 with a smaller cross section may slide farther into the tubular member 204, and a handle 104 with a larger cross section may not extend as far into the tubular member 204.

Figure 4:
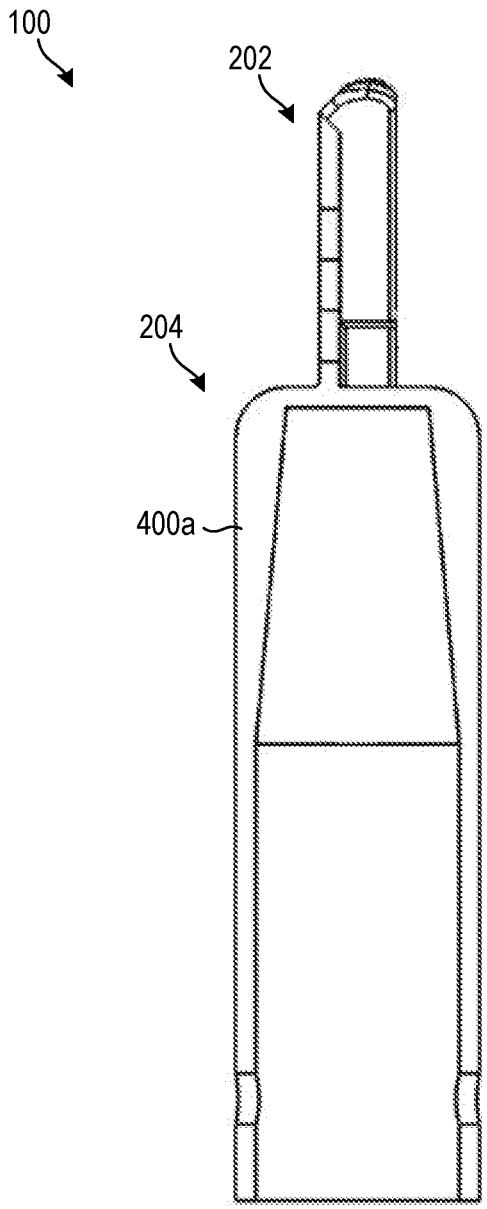
FIG. 4 is a cutaway view of a scraper apparatus in accordance with embodiments of the invention.
Figure 5:
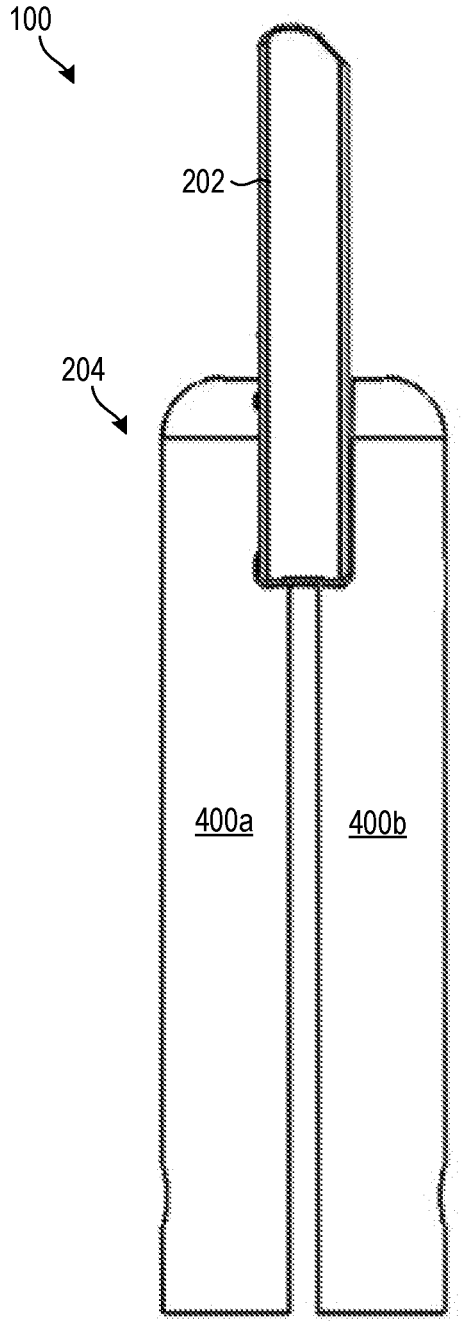
FIG. 5 is a side view of an embodiment of a scraper apparatus in accordance with the invention.

In some embodiments, the tubular member 204 may be substantially monolithic, while in other embodiments, as shown in FIGS. 4 and 5, the tubular member 204 may include two or more bodies 400*a*, 400*b*. In certain embodiments, one or more of the bodies 400*a*, 400*b* may be completely detachable from the scraper element 202. Alternatively, one or both bodies 400*a*, 400*b* may be at least partially connected to scraper element 202 or to the attachment element 200.

In any case, certain embodiments may allow the tubular member 204 to be placed over the end of the handle 104 when the bodies 400*a*, 400*b* are separated. When the two bodies 400*a*, 400*b* are brought together, they may clamp or otherwise fit onto the handle 104 to secure the scraper apparatus 100 to the handle 104. In some embodiments, the tubular member 204 may be further connected to the handle 104 using a set screw or any type of fastener known to those in the art. In one embodiment, the attachment element 200 may be fit or otherwise attached to the inside of a hollow portion of a handle 104. Of course, there are many ways that one of skill in the art may configure an attachment element 200 to attach to a cleaning tool 102 without departing from the scope of the invention.

Figure 6A:
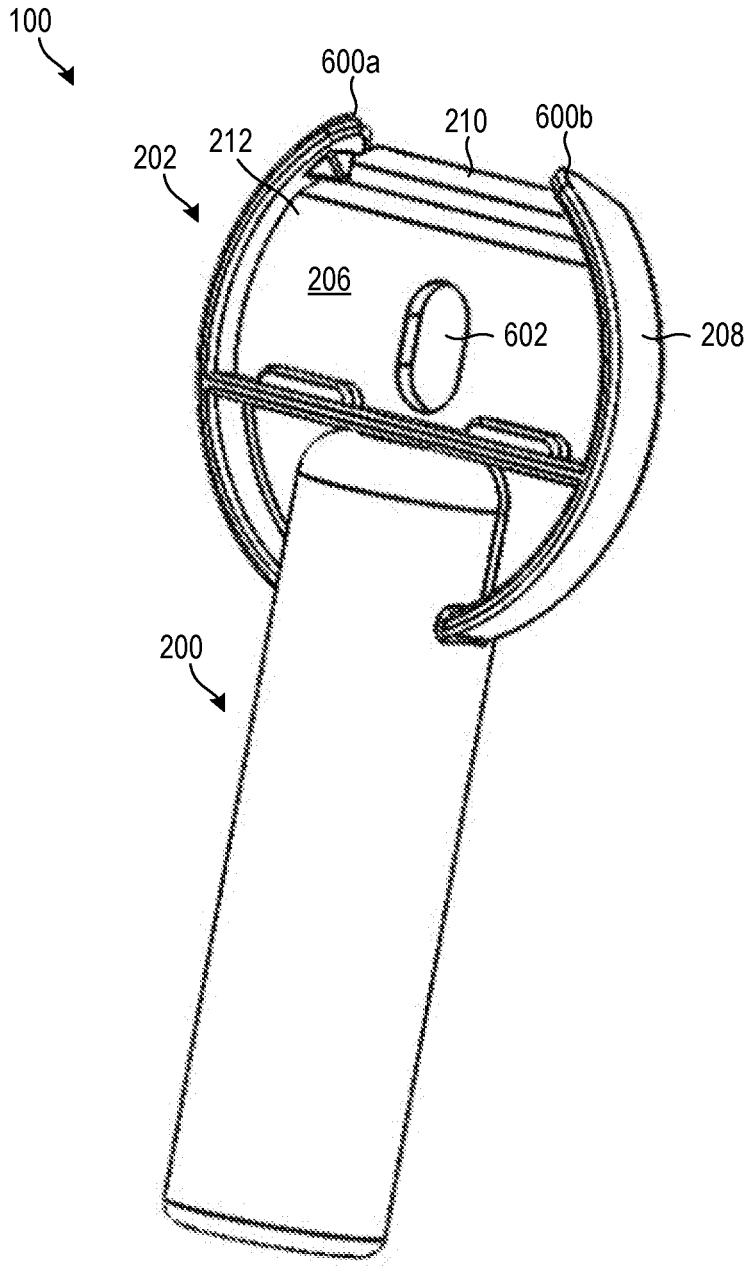
FIG. 6*a* is a perspective view of a scraper apparatus in accordance with certain embodiments of the invention.
Figure 6B:
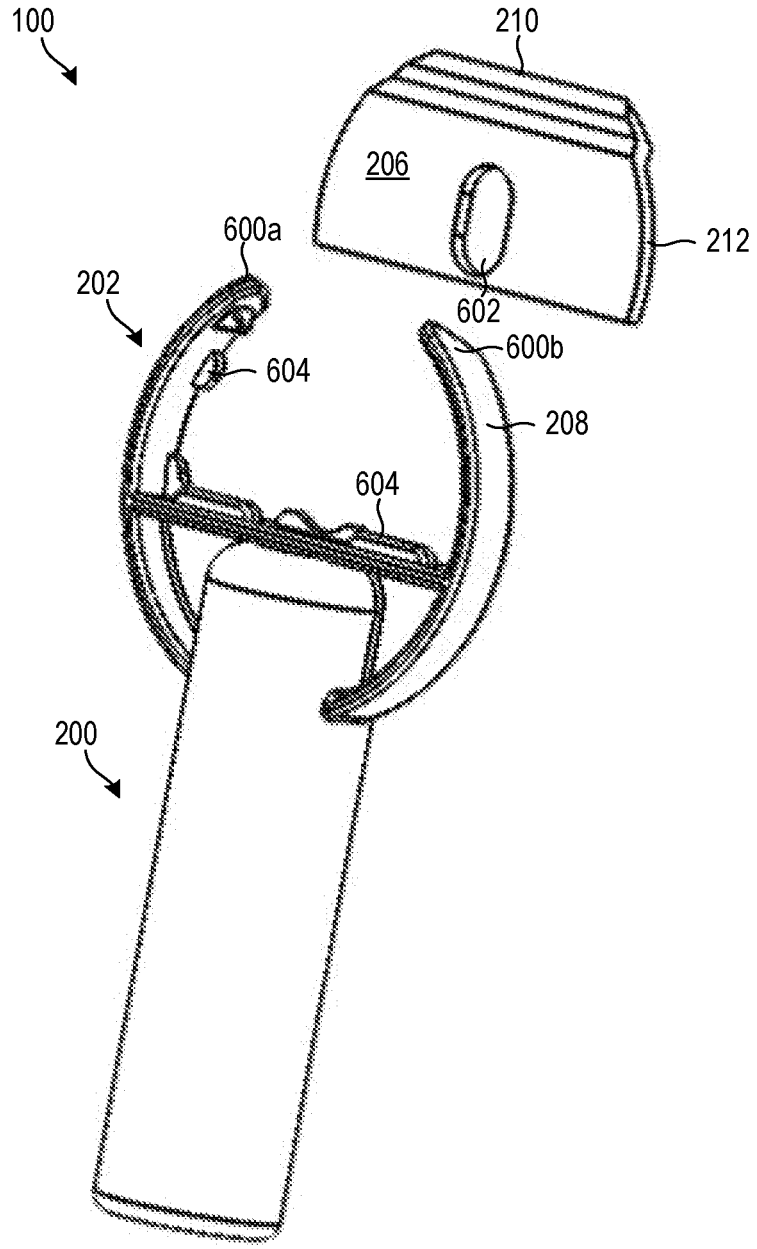
FIG. 6*b* is an exploded view of the scraper apparatus of FIG. 6*a;*

Referring now to FIGS. 6*a* and 6*b*, in some embodiments, the blade member 206 of the scraper element 202 may be integrally formed with the guard members 208 during the molding process. As the leading edge 210 of the blade member 206 will inevitably be worn down as it is used, however, it may also be a separate piece that can be replaced. In some embodiments, the blade member 206 may be made from plastic, metal, ceramic, rubber, or a combination of these materials. In some embodiments, the blade member 206 may also include an eraser for removing black marks, for example. The blade member 206 may be made removable with respect to the scraper element 202 by, for example, snapping the blade member 206 into position using one or more hooks, ledges, compliant members, and/or any other such fastening mechanism 604 known to those in the art.

In some embodiments, the scraper element 202 may include a rounded contour and, in certain embodiments, rounded corners at its distal edges 600*a*, 600*b*, so that it is comfortable to hold when using the cleaning tool 102, and so that when it falls it does not cause damage or harm to people or property. In certain embodiments, the contour of the scraper element 202 and/or guard members 208 may facilitate retention of the blade member 206 with respect thereto such that the blade member 206 is maintained in a substantially fixed position relative to the scraper element 202. In one embodiment, as shown in FIG. 6*a*, the scraper element 202 includes guard members 208 that are substantially rounded, although other shapes such as square, rectangular, oval, triangle, and the like, are anticipated.

In certain embodiments, the scraper element 202 may further include a mounting element 602 such as a hole or other securing mechanism or device to enable hanging from a hook or otherwise securing the cleaning tool 102 with respect to a wall, door, or other surface or location. In one embodiment, the mounting element 602 may be integrated with or coupled to the scraper element 202, although such a mounting element 602 or other feature may be incorporated into or coupled to any portion of the attachment element 200, scraper element 202, or other part of the scraper apparatus 100 by any means known to those in the art.

Figure 7A:
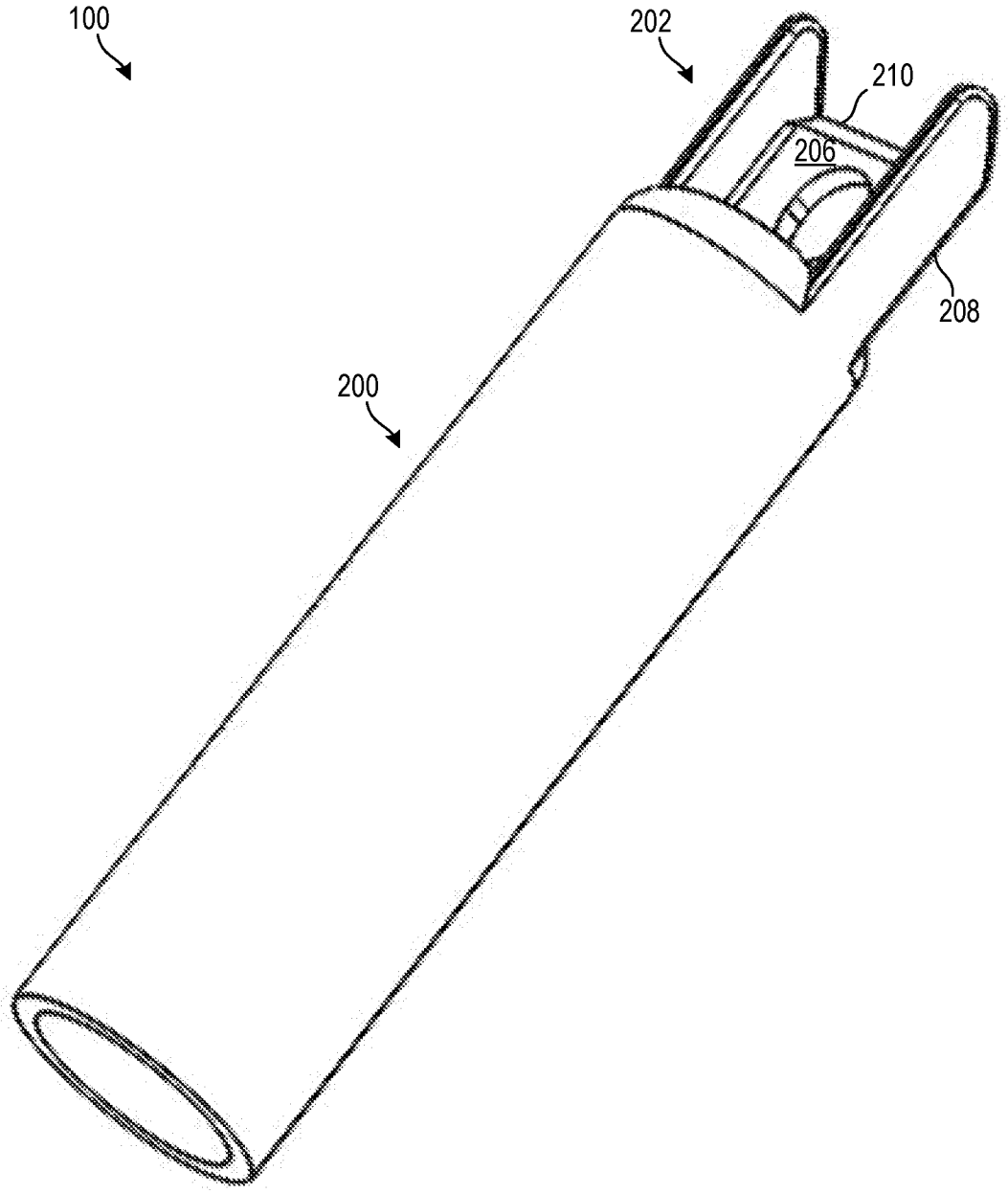
FIG. 7*a* is a perspective view of an alternative embodiment of a scraper apparatus in accordance with the invention.
Figure 7B:
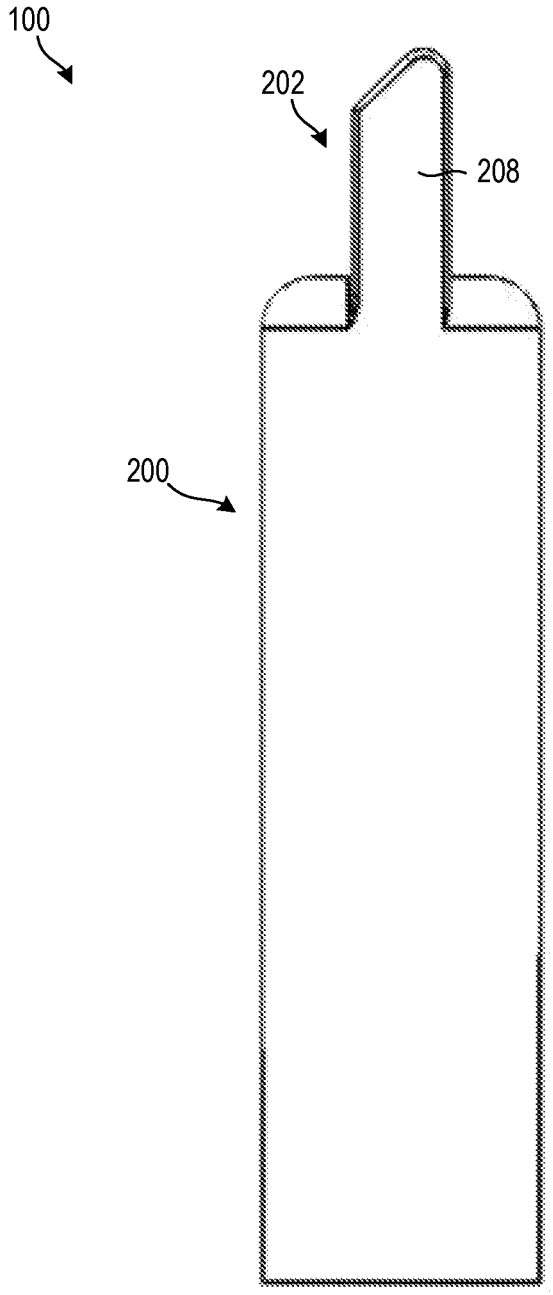
FIG. 7*b* is a side view of the scraper apparatus of FIG. 7*a;*
Figure 7C:
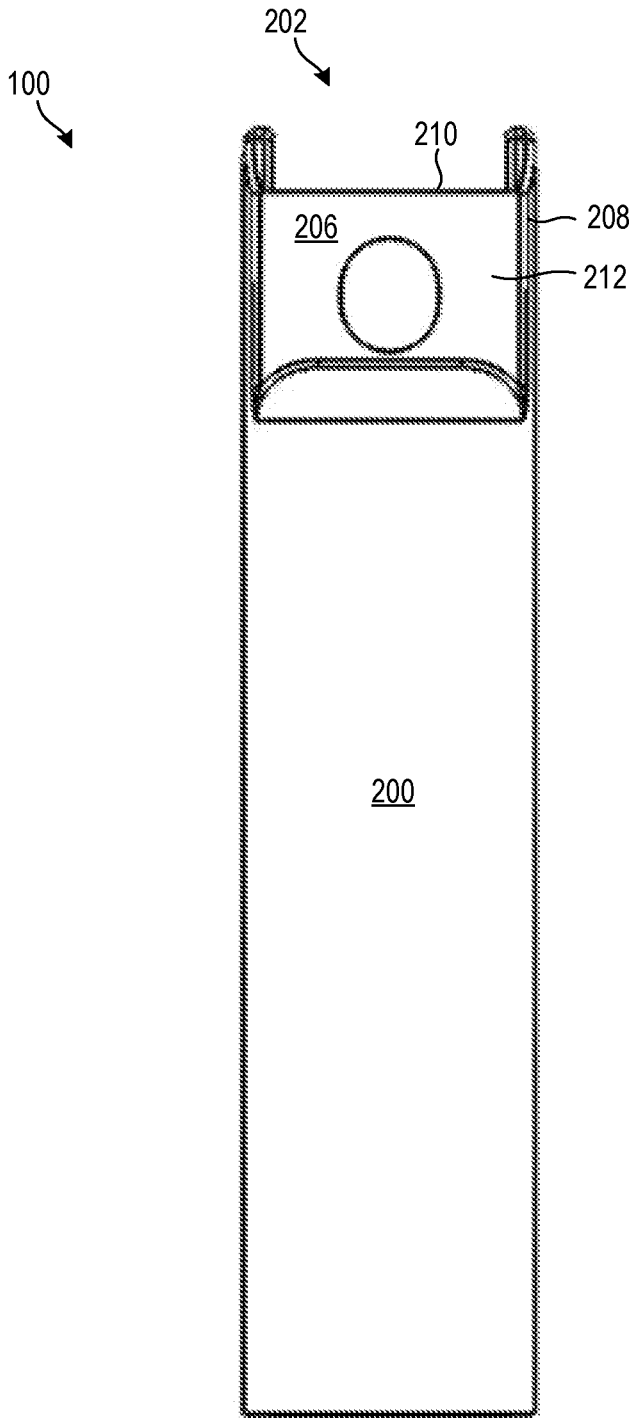
FIG. 7*c* is a front view of the scraper apparatus of FIG. 7*a*.

Referring now to FIGS. 7*a*, 7*b*, and 7*c*, an alternative embodiment of a scraper apparatus 100 in accordance with the invention is shown. As shown, this embodiment includes a scraper element 202 having substantially the same dimensions and profile as the attachment element 200. As described above, the blade member 206 may be selectively removable with respect to the scraper element 202, and the guard members 208 may include a substantially rounded contour to avoid damage or injury to surrounding structures, pets, or people in case the cleaning tool 102 falls.

Figure 8:
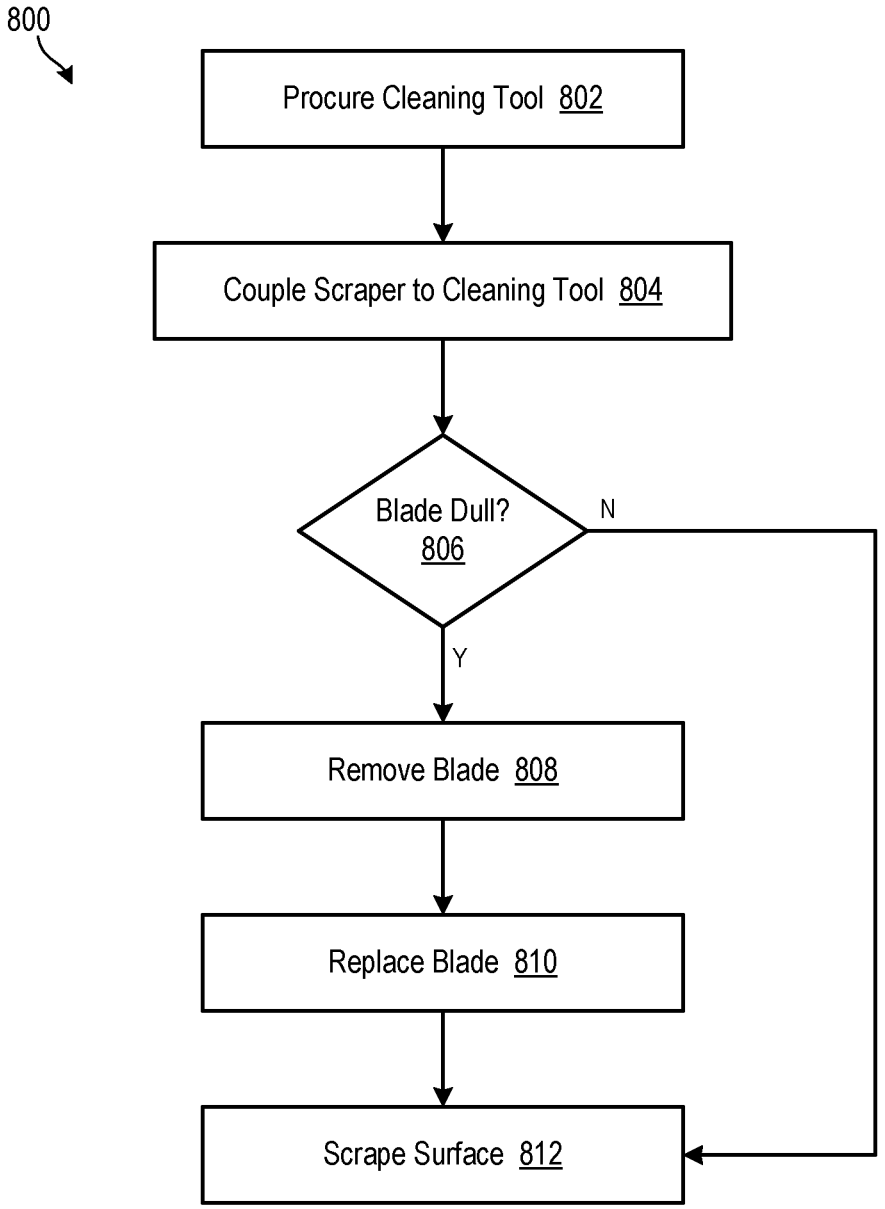
FIG. 8 is a flow chart showing a process for scraping a surface in accordance with certain embodiments of the invention.

Referring now to FIG. 8, a method 800 for scraping a surface in accordance with certain embodiments of the invention may include procuring 802 a cleaning tool, such as a broom, mop, or other such cleaning tool or device known to those in the art. A scraper apparatus may be coupled 804 to a handle or other portion of the cleaning tool by a press fit, friction, set screws, resilient members, fasteners, or the like.

The scraper apparatus may include an attachment element to attach to the cleaning tool, and a scraper element coupled to the attachment element. The scraper element may include a blade member having a leading edge and at least one lateral edge. The leading edge of the blade member may be used to scrape a surface, while a guard member may be disposed along at least one of the lateral edges to protect surrounding structures, pets and people from inadvertent damage from the blade member if the scraper apparatus falls.

The method 800 may then query 806 whether the blade is dull. If yes, the blade may be removed 808 and replaced 810 with a new or sharper blade. The surface may then be scraped 812 with the scraper apparatus as desired. If no, the existing blade may be used to scrape 812 the surface.

In the above disclosure, reference has been made to the accompanying drawings, which form a part hereof, and in which is shown by way of illustration specific implementations in which the disclosure may be practiced. It is understood that other implementations may be utilized and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

While various embodiments of the present disclosure have been described above, it should be understood that they have been presented by way of example only, and not limitation. It will be apparent to persons skilled in the relevant art that various changes in form and detail can be made therein without departing from the spirit and scope of the disclosure. Thus, the breadth and scope of the present disclosure should not be limited by any of the above-described exemplary embodiments, but should be defined only in accordance with the following claims and their equivalents. The foregoing description has been presented for the purposes of illustration and description. It is not intended to be exhaustive or to limit the disclosure to the precise form disclosed. Many modifications and variations are possible in light of the above teaching. Further, it should be noted that any or all of the aforementioned alternate implementations may be used in any combination desired to form additional hybrid implementations of the disclosure.

What is claimed is:

1. An apparatus for scraping a surface, comprising:

an attachment element configured to attach to an end of a handle of a cleaning tool; and a scraper element coupled to an end portion of the attachment element, the scraper element comprising a blade member having a leading edge to scrape a surface, the scraper element further including a pair of guard members extending from the attachment element to a free end thereof, the guard members disposed along opposite lateral edges of the blade member, the blade member being removably secured to the scraper element between the guard members, wherein free ends of the guard members extend beyond the leading edge of the blade member.

2. The apparatus of claim 1, wherein the blade member is replaceable with respect to the scraper element.

3. The apparatus of claim 1, wherein each of the pair of guard members comprises a substantially rounded contour.

4. The apparatus of claim 1, wherein the pair of guard members selectively retains the blade member in a fixed position relative to the scraper element.

5. The apparatus of claim 1, wherein the attachment element comprises at least one opening to receive the handle of the cleaning tool.

6. The apparatus of claim 1, wherein the attachment element is configured to attach to a plurality of cleaning tool handles having various sizes.

7. The apparatus of claim 1, wherein the attachment element comprises a tubular member to accommodate the handle of the cleaning tool.

8. The apparatus of claim 7, wherein the tubular member comprises at least one tapered element disposed therein.

9. The apparatus of claim 1, wherein the scraper element comprises a mounting element for selectively securing the apparatus to a surface.

10. A system for scraping a surface, comprising:

a cleaning tool having a handle;

an attachment element removably attached to the handle; and a scraper element coupled to an end portion of the attachment element, the scraper element comprising a blade member having a leading edge to scrape a surface, and a pair of guard members extending from the attachment element to a free end thereof, the guard members disposed along opposite lateral edges of the blade member, the blade member being removably secured to the scraper element between the guard members, wherein free ends of guard members extend beyond the leading edge of the blade member.

11. The system of claim 10, wherein each of the pair of guard members comprises a substantially rounded contour.

12. The system of claim 10, wherein the pair of guard members selectively retain the blade member in a fixed position relative to the scraper element.

13. The system of claim 10, wherein the attachment element comprises at least one opening to receive the handle of the cleaning tool.

14. The system of claim 13, wherein the attachment element comprises a tubular member to accommodate the handle of the cleaning tool.

15. A method for scraping a surface, comprising:

procuring a cleaning tool having a handle;

coupling a scraper apparatus to the handle of the cleaning tool, the scraper apparatus comprising:

an attachment element configured to attach to the handle of the cleaning tool; and a scraper element coupled to an end portion of the attachment element, the scraper element comprising a blade member having a leading edge to scrape a surface, the scraper element further including a pair of guard members disposed along opposite lateral edges of the blade member, the blade member being removably secured to the scraper element between the guard members, wherein free ends of the guard members extend beyond the leading edge of the blade member; and scraping a surface with the leading edge of the blade member.

16. The method of claim 15, further comprising selectively removing the blade member from the scraper element.

17. The method of claim 15, wherein each of the pair of guard comprises a substantially rounded contour.

18. The method of claim 15, wherein the attachment element comprises at least one opening to receive the handle of the cleaning tool.

* * * * *